US008899940B2

(12) United States Patent
Leugemors et al.

(10) Patent No.: US 8,899,940 B2
(45) Date of Patent: Dec. 2, 2014

(54) SUCTION STABILIZER FOR PUMP ASSEMBLY

(75) Inventors: Edward Leugemors, Needville, TX (US); Rajesh Luharuka, Katy, TX (US); Hubertus V. Thomeer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 490 days.

(21) Appl. No.: 12/892,364

(22) Filed: Sep. 28, 2010

(65) Prior Publication Data

US 2011/0110793 A1 May 12, 2011

Related U.S. Application Data

(60) Provisional application No. 61/258,924, filed on Nov. 6, 2009.

(51) Int. Cl.

| | |
|---|---|
| ***F04B 39/00*** | (2006.01) |
| ***F04F 1/00*** | (2006.01) |
| ***E03B 7/10*** | (2006.01) |
| ***F04B 43/02*** | (2006.01) |

(52) U.S. Cl.

CPC ..... *F04B 43/02* (2013.01)
USPC ..... 417/53; 417/430; 417/540; 137/207; 138/28; 138/30

(58) Field of Classification Search

USPC ..... 417/53, 430, 540, 542, 543; 137/15.07, 137/207; 138/23, 27, 28, 30, 103, 108, 116
See application file for complete search history.

(56) References Cited

U.S. PATENT DOCUMENTS

| | | | | |
|---|---|---|---|---|
| 4,585,400 | A * | 4/1986 | Miller | 417/540 |
| 6,089,837 | A * | 7/2000 | Cornell | 417/540 |
| 7,621,728 | B2 * | 11/2009 | Miller | 417/568 |

FOREIGN PATENT DOCUMENTS

| | | |
|---|---|---|
| WO | 02064977 | 8/2002 |

OTHER PUBLICATIONS

WR Mattco Reciprocating Pump Pulsation Control Equipment Brochure—downloaded Nov. 2010 from: http://www.mattcomfg.com/Downloads.aspx.

* cited by examiner

*Primary Examiner* — Charles Freay
(74) *Attorney, Agent, or Firm* — Jeffrey R. Anderson; Rachel E. Greene; Tim Curington

(57) ABSTRACT

A fluid flow stabilizing method and a pump having a stabilized fluid flow passage where a process fluid contains suspended solid particles and is subject to pressure oscillations. The method comprises positioning an expandable membrane along the lower transverse surface, inflating the membrane with a compressible fluid, and alternatingly expanding and contracting the membrane to dampen the pressure oscillations and inhibit settling of the solid particles at the lower transverse surface. The pump comprises a stabilizer comprising a compressible fluid in an expandable membrane elongated along the lower transverse surface of a manifold in fluid communication with the fluid end. Another method comprises reciprocating a plunger in the pump to pass a slurry through the manifold, and alternatingly expanding and contracting a stabilizer in the manifold.

22 Claims, 5 Drawing Sheets

SUCTION STABILIZER FOR PUMP ASSEMBLY

CROSS REFERENCE TO RELATED APPLICATION(S)

This application claims the benefit of and priority to U.S. provisional application 61/258,924, filed Nov. 6, 2009.

STATEMENT REGARDING FEDERALLY SPONSORED RESEARCH OR DEVELOPMENT

Not applicable

THE NAMES OF PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION (1) Field of the Invention

The invention is related in general to wellsite surface equipment such as positive displacement pumps such as fracturing pumps and the like.

(2) Description of Related Art Including Information Disclosed Under 37 CFR 1.97 and 1.98

Hydraulic fracturing of downhole formations typically involves pumping slurry containing suspended proppant, gravel or other solids, at relatively high pressures so as to fracture the rocks. Triplex reciprocating pumps, i.e., a pump having a fluid end with three cylinders, are generally used to pump high pressure fracturing fluids downhole, although other pumps such as quintuplex pumps can also be used.

The pumping cycle of the fluid end cylinders is composed of two stages, a suction cycle and a discharge cycle. In the suction cycle a piston moves outward in a packing bore, thereby lowering the fluid pressure in the fluid end cylinder, opening the suction valve and filling the cylinder with the fluid from a suction pipe, which is sometimes referred to as the suction manifold. In some cases, the pressure is 2-3 times the atmospheric pressure, approximately 0.28 MPa (40 psi). In the discharge cycle, the plunger moves forward in the packing bore, thereby progressively increasing the fluid pressure in the pump, closing the suction valve, opening the discharge valve, and the high pressure fluid flows out of the cylinder into the discharge pipe, and in some cases at 14 to 140 MPa (2 to 20 kpsi).

A positive displacement pump used in high pressure pumping services, such as fracturing and the like, typically require suction stabilization such as pulsation control or the like. The large acceleration head caused by the high volume of fluid between the pump cylinder inlet and the actual stabilizer bladder sometimes are difficult for the stabilizer to overcome. The acceleration head is increased with a higher density fluid, such as fracturing fluid or the like. Many suction stabilizers are mounted disadvantageously external of the suction manifold. Appendage pneumatic or air tank suction stabilizers are known, for example, from WO 02064977 (2002) and U.S. Pat. No. 6,089,837 (2000). Those suction stabilizers mounted on the suction manifold are disadvantageously heavy, are high in cost and require high maintenance.

Suction stabilizers may also be formed from or with a closed cell cellular foam material which have a relatively high gas volume without nitrogen charging. According to the manufacturer, proper sizing and setup is important to performance of the pulsation control equipment, whereas the installed location of the pulsation control equipment is critical, and the recommended location for the pulsation control equipment is within 6 times the nominal pipe diameter of the pump manifold connections. Suction stabilizers are not effective when installed away from the pump. Also, closed cell foams cannot always be utilized with certain materials, such as solvents or the like.

In positive displacement pumps such as fracturing pumps, sand, proppant, or other oilfield materials may build up in the suction manifold at lower pumping rates. Such a buildup may reach a point where the buildup may block the entrance to the pump plunger and cause problems including, but not limited to, cavitations in the cylinder or an introduction of large sand concentration into the pump cylinder causing piston hammer and further physical damage to the pump, the engine, and/or the transmission. While it is known to stabilize the velocity variation of the pump suction feed stream using closed cell foam, these suction stabilizers are not always effective in keeping solids from building up.

It remains desirable to provide improvements in wellsite surface equipment in efficiency, flexibility, reliability, and maintainability.

BRIEF SUMMARY OF THE INVENTION

According to an embodiment, an expandable membrane is positioned along a lower transverse surface of a fluid flow conduit that may contain solids and/or be subject to pressure oscillations. The membrane is inflated with a gas isolated from the fluid flow, and the membrane is alternatingly expanded and contracted to dampen the pressure oscillations and inhibits settling of any solid particles at the lower transverse surface. The expansion and contraction pulsations can be actively applied via external pressurization and depressurization, or caused passively, e.g., by pump stroke cycles in one embodiment where the stabilizer is used in a pump manifold or other conduit associated with the pump.

In an embodiment, a stabilized pump manifold, comprises a manifold in fluid communication with a fluid end of a pump for passage of a process fluid therethrough over a lower surface transverse to vertical, wherein the lower surface is elongated in a direction of fluid flow through the manifold; and a stabilizer comprising a compressible fluid in an expandable membrane elongated along the lower transverse surface in the direction of fluid flow to dampen pressure oscillations within the manifold. In an embodiment where the process fluid being pumped is a slurry, the stabilizer can also inhibit solids settling at the lower transverse surface. In an embodiment, the manifold comprises an inlet to the fluid pump and the stabilizer is a suction stabilizer. In an embodiment, the slurry comprises an oilfield fluid and the solids comprise proppant, sand or a mixture thereof.

In one embodiment, the process fluid comprises a slurry. In one embodiment, the fluid pump comprises a plurality of chambers with reciprocating plungers to alternatingly suction and discharge the slurry. In one embodiment, the manifold comprises a like plurality of branches transverse to the elongated lower surface to supply the slurry to the chambers. In an embodiment, the manifold dissipates an acceleration head during normal operation of the plungers.

In an embodiment, the membrane is formed from a compliant material, for example, a resilient structure defining an elongated chamber such as a hose, preferably a polymeric or elastomeric hose. In an embodiment, the hose is in fluid communication with a source of the compressible fluid at a pressure exceeding a pressure of the slurry in the manifold corresponding to a low pressure cycle. In an embodiment, the compressible fluid is compressed air.

In an embodiment, variation of the compressible fluid pressure is adapted to displace solids from the lower transverse surface.

In an embodiment, the stabilizer comprises a retainer to secure the membrane adjacent the lower transverse surface. In an embodiment, the stabilizer comprises a tapered insert in the membrane adjacent an attachment fitting.

In another embodiment, a method comprises: reciprocating a plunger in a fluid end of a pump to alternatingly suction and discharge a slurry; passing the slurry through a manifold in fluid communication with the fluid end, wherein the manifold comprises a lower surface transverse to vertical; and alternatingly expanding and contracting a stabilizer comprising a compressible fluid in an expandable membrane elongated along the lower transverse surface to dampen pressure oscillations within the manifold and inhibit solids settling at the lower transverse surface.

In an embodiment, the method further comprises expanding the membrane during the low pressure cycle and compressing the membrane during the high pressure cycle. In an embodiment, the manifold comprises an inlet to the fluid pump and the method further comprises expanding the stabilizer during a low pressure cycle and contracting the stabilizer during a high pressure cycle. In an embodiment, a pressure variation between the low and high pressure cycles is effective to displace solids from the lower transverse surface.

In an embodiment, the method comprises securing the membrane adjacent the lower transverse surface. In an embodiment, the method comprises providing a tapered insert in the membrane adjacent a connection fitting to support the membrane during compression.

In another embodiment, a method for stabilizing fluid flow in a flow conduit having a lower surface transverse to vertical in contact with the fluid, wherein the fluid contains suspended solid particles and is subject to pressure oscillations, comprises: positioning an expandable membrane along the lower transverse surface; inflating the membrane with a gas isolated from the fluid flow; and alternatingly expanding and contracting the membrane to dampen the pressure oscillations and inhibit settling of the solid particles at the lower transverse surface. In an embodiment, the flow conduit comprises an inlet manifold to a positive displacement pump, the fluid comprises a proppant- or sand-laden oilfield treatment fluid, and the expandable membrane comprises a continuous, elongated chamber such as, for example, a hose.

DETAILED DESCRIPTION OF THE INVENTION

Figure 1:
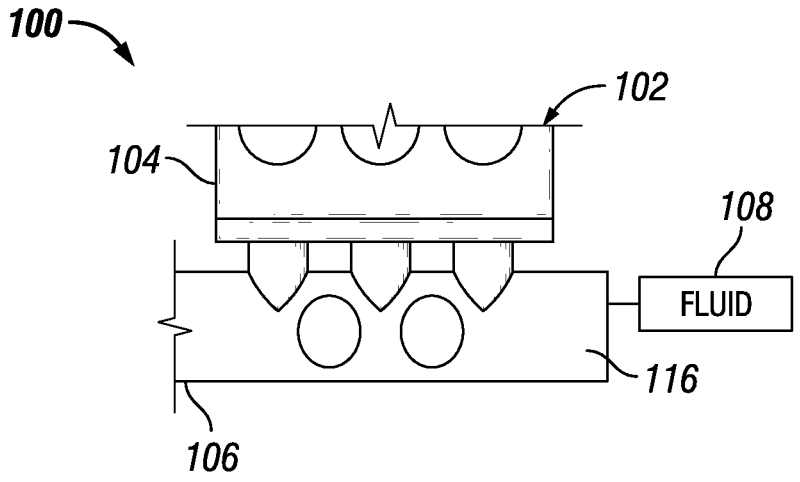
FIG. 1 (Prior Art)
FIG. 1 is a schematic diagram of the fluid end of a conventional triplex pump assembly (prior art).

Referring now to all of the Figures, there is disclosed a pump assembly, indicated generally at 100. The pump assembly 100 comprises a pump 102, coupled to a suitable prime mover (not shown) such as a diesel engine, a gasoline engine, an electric motor, or any suitable prime mover through a suitable transmission (not shown) or the like, as will be appreciated by those skilled in the art. The pump 102 comprises a pump body 104 having a suction manifold 106 attached thereto and in fluid communication with a source of fluid 108 (i.e. "process fluid") to be pumped, such as a proppant-laden oilfield fluid or the like.

In an embodiment, the proppant used in oilfield treatment fluids, which is also sometimes called gravel or sand, will comprise particle sizes within the ranges from about 0.15 mm to about 2.39 mm (about 8 to about 100 U.S. mesh), more particularly, but not limited to 0.25 to 0.43 mm (40/60 mesh), 0.43 to 0.84 mm (20/40 mesh), 0.84 to 1.19 mm (16/20 mesh), 0.84 to 1.68 mm (12/20 mesh) and 0.84 to 2.39 mm (8/20 mesh) sized materials. In one embodiment, the proppant will be present in the slurry in a concentration of from about 0.12 to about 3 kg/L, e.g., from about 0.12 to about 1.44 kg/L (about 1 PPA to about 25 PPA, preferably from about 1 to about 12 PPA; PPA is "pounds proppant added" per gallon of liquid). In another embodiment, the proppant will be present at greater than 3 kg/L (25 PPA) or greater than 3.6 kg/L (30 PPA), up to a maximum concentration where the slurry can still be pumped. Such proppants may be natural or synthetic (including but not limited to glass beads, ceramic beads, sand, and bauxite), coated, or contain chemicals; more than one may be used sequentially or in mixtures of different sizes or different materials, as is known in the art. The process fluid may also include various additives and chemicals commonly used in well treatment fluids, such as polymers, viscosifiers, surfactants, fluid loss agents, pH stabilizers, breakers, accelerators, friction reducers, and the like.

In an embodiment, a stabilizer device or devices, discussed in more detail below, is provided as part of the pump assembly 100 and is operable to dampen oscillations within a portion of the pump body 104, within the suction manifold 106 and/or suspend solids within the oilfield fluid 108 that may be disposed within the oilfield fluid 108. The stabilizer device or devices may be disposed external to the pump assembly 100 or disposed within the pump body 104, within the suction manifold 106 or at any suitable location within the pump assembly where oscillations may be dampened or solids suspended, as will be appreciated by those skilled in the art.

Figure 2:
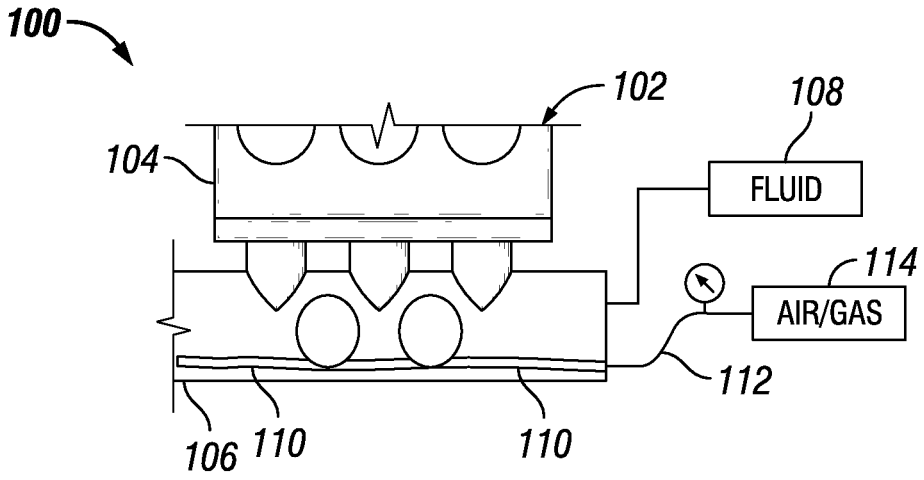
FIG. 2 is a schematic diagram of the triplex pump assembly of FIG. 1 modified with a suction stabilizer according to an embodiment of the invention.

In an embodiment, a stabilizer or stabilizer device 110, best seen in FIG. 2 is inserted into the interior of the suction manifold 106. In an embodiment, the stabilizer 110 comprises a compliant chamber, preferably defining a continuous, elongated chamber such as, for example, an air or gas pressurized hose disposed in the bottom of the suction manifold 106. The stabilizer 110 may be formed from any suitable compliant material, as will be appreciated by those skilled in the art. The stabilizer device 110 may comprise a compliant blender hose or a petroleum hose made of nitrile rubber, e.g., BUNA-N, hydrogenated nitrile butadiene rubber (HNBR), fluorinated elastomer such as fluorinated ethylene-propylene (FEP) or VITON, synthetic rubber, natural rubber, polyurethane, polyethylene, or any suitable compliant material.

The hose may have a protective cover on the outside to improve its chemical resistance such as a layer or coating of TEFLON polytetrafluoroethylene (PTFE), nylon, FEP, and like. Such a coating or cover may improve the chemical resistance of the stabilizer 110 to fracturing fluids, solvents, etc., and improve the wear resistance of the stabilizer 110. The stabilizer 110 may comprise a gas chamber made of a pliable material suitable for the fluids being pumped. The stabilizer 110 may comprise a bladder or hose, custom built to fit the suction manifold 106. To keep the stabilizer 110 at the bottom of the suction manifold 106 and in a desired orientation, a heavy rod or other smooth shape can be inserted on an interior of the stabilizer 110 or bonded to the outside of the stabilizer 110. The stabilizer 110 may be placed within a perforated cage to allow the pulsations to be damped. The stabilizer 110 may comprise a compliant mechanical bellows. The stabilizer 110 may comprise a section of fire hose or similar suitable material. Those skilled in the art will appreciate that the stabilizer 110 may be a mechanically compliant hose or device such as a chamber or a bellows and the compliance of the stabilizer 110 may be a combination of mechanical and pressurized air compliance The stabilizer 110 may be pressurized via a pressurizing line 112 from a source 114 of compressible fluid, such as pressurized gas or air. The pressure from the air source 114 may be advantageously varied depending on the specifics of the oilfield services operation of the pump assembly 100 and pump 102. The manifold 106 may be a pre-existing manifold or it may be enlarged to accommodate the stabilizer 110. During operation of the assembly 100, the stabilizer 110 acts as an internal dampener or pulsation bottle and dampens pressure pulsations within the manifold 106. By locating the stabilizer 110 directly within the suction manifold 106, the dampener is located in close proximity to the pump cylinder inlet, advantageously reducing the amount of acceleration head for the assembly 100.

The stabilizer 110 formed from a hose material is more cost effective, it allows the use of the pump for pumping solvents if the proper material is used. The stabilizer 110 may be advantageously retrofitted in existing pumps, such as the pump 102. In those situations where the pump assembly 100 is utilized for pumping liquid $CO_2$ or the like, the stabilizer 110 can be removed. The stabilizer hose 110 is advantageously lighter in weight, which is advantageous for mobile applications where legal weight limits is applied, such as on an offshore platform or on a vessel, and it is mechanically simpler and easier to maintain and/or replace while providing good suction stabilization properties for the pump assembly 100.

The stabilizer device 110 also advantageously provides proppant suspension to the assembly 100. When located at the bottom of the manifold 106, the stabilizer device 110 will oscillate and thereby fluidize any sand, proppant, or oilfield material 116, best seen in FIG. 1, that is near or comes in contact with it because the sand, proppant, or oilfield material 116 often settles to the bottom of manifold 106 by gravity during operation of the assembly 100. The pressure pulsations of the stabilizer 110 may be a result of the pressure pulses of the pump plungers causing a pressure differential within the manifold 106, which further causes the compressed gas in the stabilizer 110 to expand and contract. The oscillation of the stabilization device 110 may be externally induced, such as by a vibration device, a moving part, a rotating part, a pulse generator to drive the stabilizer device 110. The oscillation keeps the proppant 116 fluidized and inhibits potential plugging by allowing proppant-laden fluid 108 to flow easily. The stabilizer hose 110 advantageously does not allow proppant 116 to settle in the suction header or manifold 106, providing an even distribution of proppant 116 within the manifold 106 and therefore between plungers, provides less wear on front valve (which may be the first to fail) and reduces the risk of blocking flow to the pump assembly 100 while also providing the suction stabilization noted above. In an embodiment, the stabilization device 110 may be supplemented and/or replaced by a device that induces oscillation distinct from any stabilization device 110 for the purpose of fluidizing any sand, proppant, or oilfield material 116 within the suction header 106 or any suitable location within of the pump assembly 100. Such an oscillation device may be energized separately from the pump or by the power source of the pump.

In an embodiment, the stabilizer 110 comprises a distributed weight, such as a rod, a semi-circular pipe, or the like, attached thereto ensure that the air filled hose is substantially localized at the bottom of the manifold. In an embodiment, the stabilizer 110 is coupled with an internal pulse generator, such as an air pulse generator inside the stabilizer 110, or a remotely located pulse generator that may further improve the capacity of the stabilizer 110 to fluidize the oilfield materials 116.

In an embodiment, the stabilizer 110 may be located in the high pressure treating iron (external from the suction manifold 106) to attenuate discharge pressure fluctuations and acoustics. In an embodiment, multiple pumps, such as the pump 102, are connected to a common suction manifold or missile and the stabilizer 110 is disposed inside the low pressure suction piping of the missile. In an embodiment, multiple pumps, such as the pump 102, are connected to a common discharge manifold or missile and the stabilizer 110 is disposed inside the high pressure piping or missile. In an embodiment, the length of the stabilizing device 110 may be varied to tune it to the piping acoustics of its installation. Those skilled in the art will appreciate that the stabilizer 110 may be located in any portion of a pump assembly, such as the pump assembly 100 or its associated piping where it is advantageous to provide pressure stabilization with the use of a compliant chamber or stabilizer 110.

Figure 3:
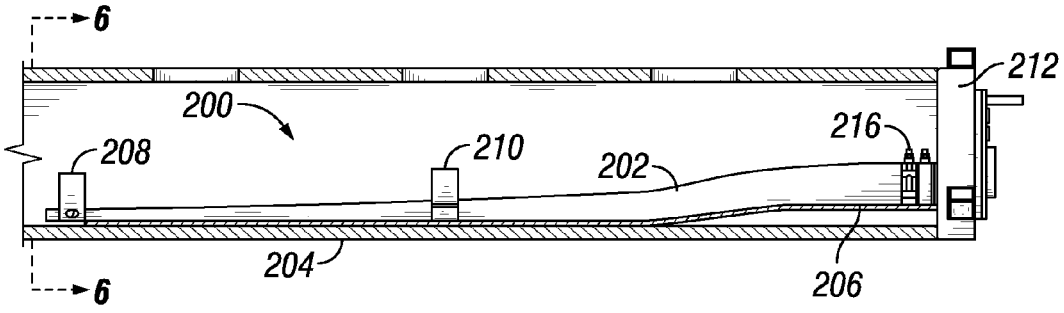
FIG. 3 is a side elevation shown in section of a hose secured adjacent the lower surface of an inlet manifold according to an embodiment of the invention.
Figure 4:
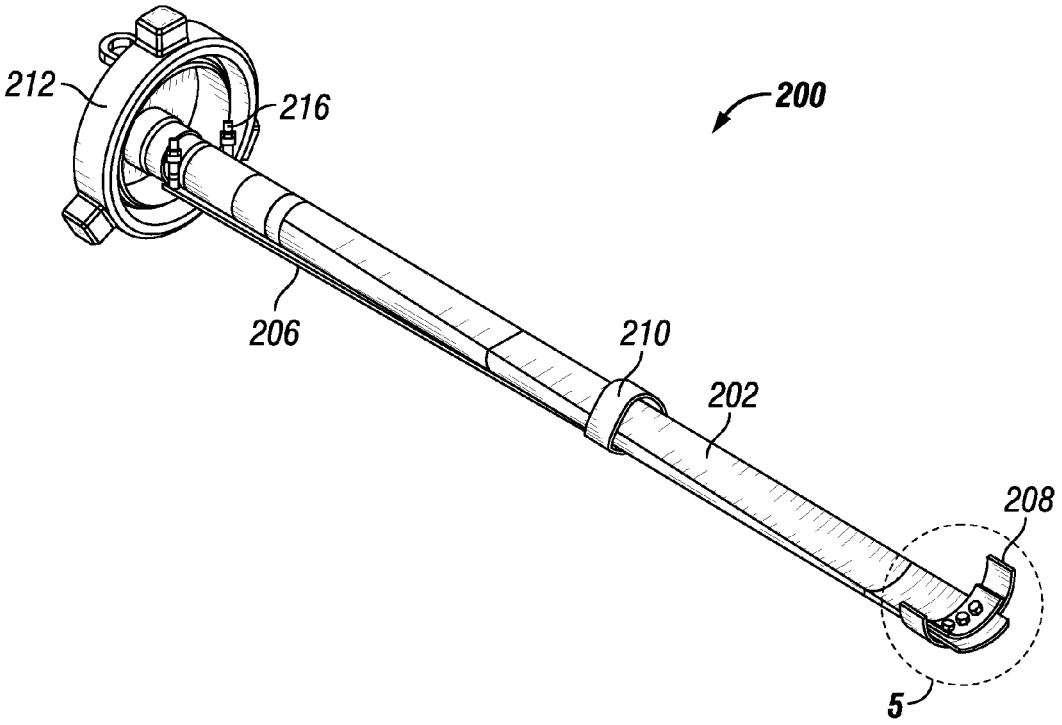
FIG. 4 is a perspective view of the hose assembly of FIG. 3 according to an embodiment.
Figure 5:
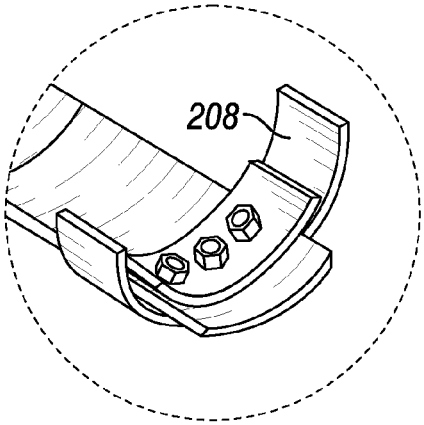
FIG. 5 is a view of detail 5 of FIG. 4 showing the end clamp assembly of the hose according to an embodiment.
Figure 6:
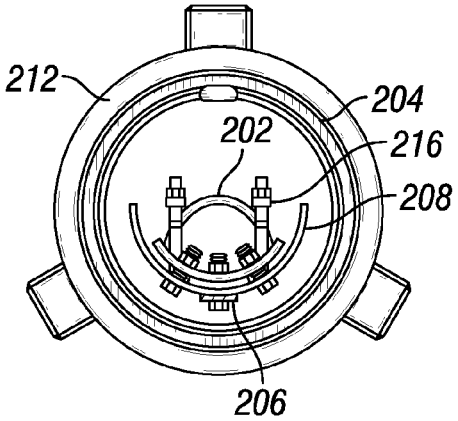
FIG. 6 is a cross sectional view of the hose assembly of FIG. 3 as seen along the line 6-6 according to an embodiment.

With reference to FIGS. 3-8, another embodiment of the inlet stabilizer device 200 is shown. The stabilizer 200 includes a section of resilient hose 202 disposed along the bottom of the inlet manifold 204 as best seen in FIG. 3. The hose 202 is secured to a metal bar or rod 206 by means of a clamp 208 at the free end of the hose 202 and one or more intermediate clamps 210. The metal bar 206 serves to counteract any buoyant forces and hold the hose 202 adjacent the lower surface of the inlet manifold 204. The end clamp 208 can be provided in a flattened or curved profile which also serves to seal the free end of the hose to keep the air or other compressible fluid from escaping from the hose into the manifold 204, as best seen in FIGS. 5 and 6.

The other end of the hose 202 is attached to a mounting flange 212 at the end of the horizontal pipe section of the manifold 204 via a hose attachment fitting 214 which can be threaded or welded at a bore through the flange 212 in embodiments, and the hose 202 secured via hose clamp 216. An end of the bar 206 can also be secured to the hose attachment fitting 214, e.g., by welding.

Figure 7:
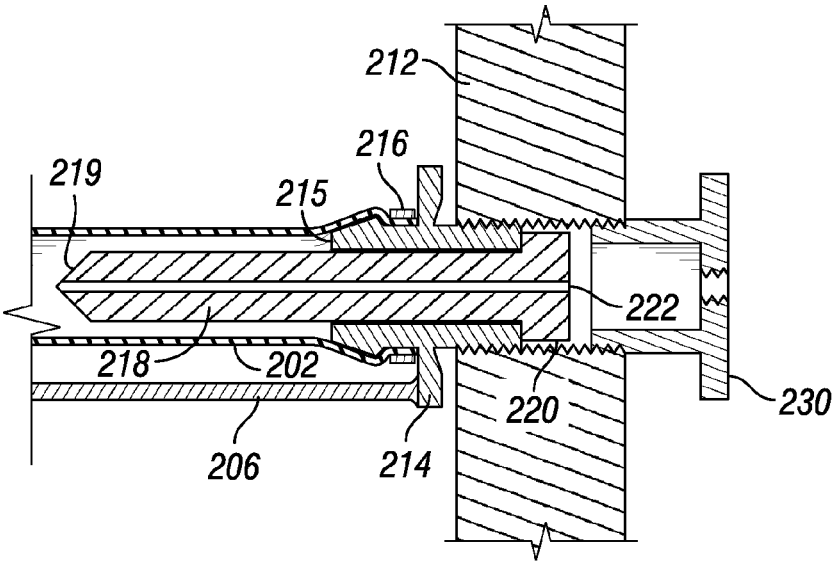
FIG. 7 is a cross sectional view of the flange connection assembly in the hose assembly of FIG. 3 according to an embodiment.

In an embodiment as best seen in FIG. 7, a nipple insert 218 made of metal, wood, plastic, etc., extends from the attachment fitting 214 at least 1 diameter, preferably 3 to 6 inside diameters of the hose 202, into the end of the hose 202 to a taper 219 at the opposite end of the insert. The insert 218 reduces the stress level of the hose 202 at the attachment fitting 214 due to repetitive expansion and contraction of the hose 202 which might otherwise lead to failure of the hose 202 at the square edge of the attachment fitting 214. In the depicted embodiment, the insert 218 is provided with an enlarged shoulder 220 having an outside diameter larger than a bore through the attachment fitting 214, and permeability to fluid which can be provided by means of one or more longitudinal bores 222, an annular passage formed between the insert 218 and the attachment fitting, and/or a porous structure of the body of the insert 218. The attachment fitting 214 can also be provided with a smooth, tapered end 219 to inhibit cutting of the hose 202.

Figure 8:
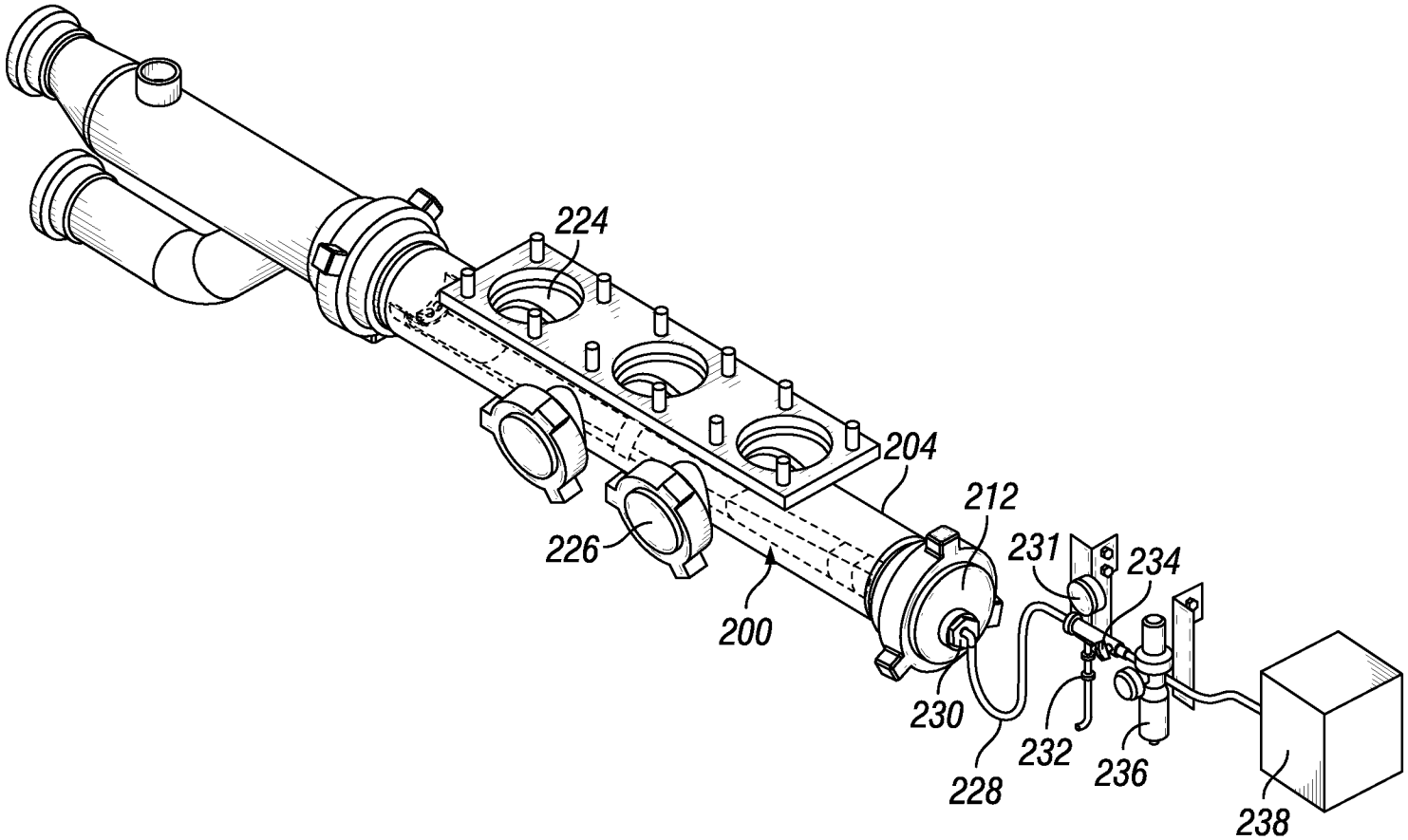
FIG. 8 is a perspective view of the hose assembly of FIGS. 3-7 in a suction manifold according to an embodiment.

To assemble the inlet stabilizer 200 in the manifold 204 for operation, in one embodiment, the stabilizer 200 is assembled and inserted in the horizontal pipe section of the manifold 204 and the flange 212 secured via threading or bolting, as best seen in FIG. 8. This positions the hose 202 directly beneath the pump fluid end inlets 224 and adjacent the side ports 226. An air supply hose 228 is connected at the air connection fitting 230 of the flange 212, provided with local pressure gauge 231 and/or remote pressure transmitter 232, valve 234, pressure regulator 236 and a source 238 of compressible fluid, such as a tank of compressed air or a compressor or the like. If desired, a pressure stabilizer such as an orifice or porous insert (not shown) may be positioned in the air hose 228 to inhibit motion or vibration which can sometimes result from pressure cycling, especially where the hose 228 is a resilient or flexible material. If desired, a foam or liquid sealant may be injected into the hose 202 to inhibit leaks.

In operation, before introducing the fracturing fluid into the manifold 204 at pressure, the valve 234 is opened to inflate the hose 202 to operating pressure, generally a lower pressure than the peak manifold pressure during pump operation. Then the valve 234 is closed and the pump operated. Pressurization of the manifold 204 then compresses the hose 202 to equalize pressure therein. Compression of the hose 202 corresponds generally to a discharge cycle of the pump. During the suction cycle, the pressure in the manifold may tend to drop and the hose 202 expands to facilitate stabilization of the inlet flow/pressure conditions.

In operation, the change in volume in the hose 202 in each pump cycle corresponds to the delta volume of the pumping operation. The volume of the hose and the initial air pressure are selected to obtain the desired dampening. If the inlet is underdamped the pressure/volume changes are excessive; if overdamped, the volume changes may be insufficient to inhibit solids settling. In one embodiment, the dampening is effective to obtain a peak-to-peak pressure fluctuation of about 35 to 210 kPa (5 to 30 psi), more preferably about 35 to 105 kPa (5 to 15 psi) and especially about 70 kPa (10 psi). The volume of the hose 202 should be sufficient to exceed the pump delta volume in one embodiment, and should not occupy excessive volume so as to interfere with the flow of the fluid to the pump cylinder inlets. In embodiments, the hose 202 is a circular hose although other shapes such as oval or wide and flat are contemplated, and occupies from 2 to 50 percent of the manifold pipe volume fully inflated, preferably 5 to 20 percent of the pipe volume. In one exemplary embodiment the hose has a nominal diameter of 50.8 mm (2 in.) and the horizontal manifold pipe receiving the hose 202 has a nominal diameter of 152 mm (6 in.). In embodiments, the hose 202 is pressurized with air or nitrogen although other compressible fluids could be used, preferably at about 30 to 70 percent of the operating suction gauge pressure, more preferably about half of the suction gauge pressure. In one embodiment the suction gauge pressure is about 400 kPa (60 psig), and in another embodiment about 800 kPa (120 psig). In one embodiment the minimum pressure of the air in the hose is 70 kPa (10 psig). In another embodiment, the inflation pressure of the air in the hose 202 is about 140 to 280 kPa (20 to 40 psig), especially about 210 kPa (30 psig).

Figure 9:
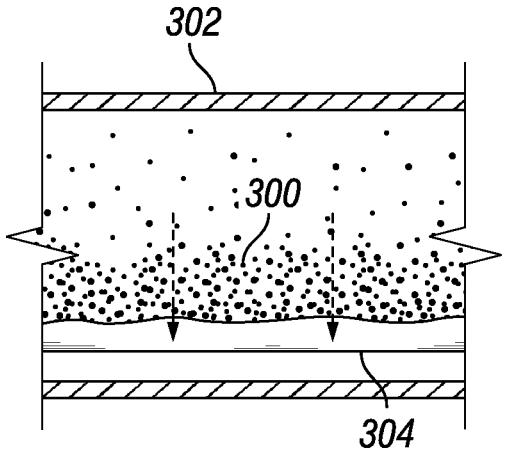
FIG. 9 is a schematic diagram of a hose stabilizer during a discharge cycle according to an embodiment.
Figure 10:
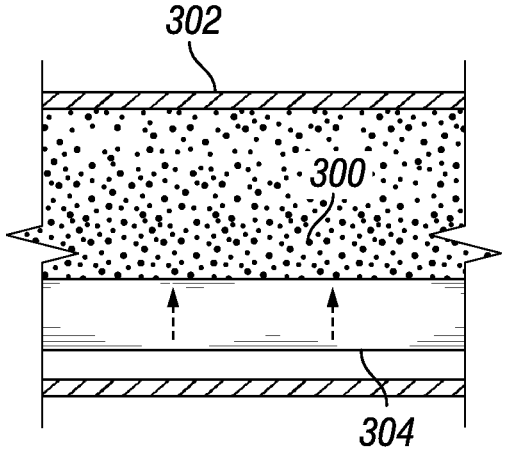
FIG. 10 is a schematic diagram of the hose stabilizer of FIG. 9 during a suction cycle according to an embodiment.

One benefit of the inlet stabilizer device of the present invention is the facilitation of particle suspension and inhibition of settling in the suction manifold, which as previously mentioned can cause cavitation if the inlet bores are plugged and/or damage the pump if a slug of sediment enters the fluid cylinder. With reference to FIGS. 9 and 10, FIG. 9 shows the tendency of dense solids 300 to settle out during a fluid discharge cycle when the velocity is lowest in the inlet manifold 302. During this low velocity stage, the pressure is highest in the manifold 302 and the hose 304 is compressed. In the suction cycle, the pressure in the inlet manifold 302 is reduced and the hose 304 is expanded proportionately. The repeated expansion and contraction of the hose 304, preferably in a cyclical pattern corresponding to the pump speed, agitates the fluid and promotes suspension of particles 300 as shown in FIG. 10. The agitation can be augmented during operation or provided while the pump is idled by provided by cycling the hose pressure between expanded and contracted conditions by cycling the pressure of the air above and below the pressure in the manifold 302 at an effective frequency, e.g., the frequency of pressure fluctuations during operation, via the air supply.

Accordingly the invention provides the following embodiments:

A. A stabilized pump manifold, comprising:
   - a manifold in fluid communication with a fluid end of a pump for passage of a process fluid therethrough over a lower surface transverse to vertical, wherein the lower surface is elongated in a direction of fluid flow through the manifold; and
   - a stabilizer comprising a compressible fluid in an expandable membrane elongated along the lower transverse surface in the direction of fluid flow to dampen pressure oscillations within the manifold.

B. The stabilized pump manifold of embodiment A wherein the manifold comprises an inlet to the pump and the stabilizer is a suction stabilizer.

C. The stabilized pump manifold of embodiment A or embodiment B wherein the fluid comprises a slurry, the fluid pump comprises a plurality of chambers with reciprocating plungers to alternatingly suction and discharge the slurry, and the manifold comprises a like plurality of branches transverse to the elongated lower surface to supply the slurry to the chambers.

D. The stabilized pump manifold of embodiment C wherein the manifold dissipates an acceleration head during normal operation of the plungers.

E. The stabilized pump manifold of any one of embodiments A to D wherein the membrane is formed from a compliant material.

F. The stabilized pump manifold of any one of embodiments A to E wherein the membrane defines a continuous, elongated chamber, preferably a hose.

G. The stabilized pump manifold of any one of embodiments A to F wherein the membrane comprises a hose in fluid communication with a source of the compressible fluid at a pressure exceeding a pressure of the slurry in the manifold corresponding to a low pressure cycle.

H. The stabilized pump manifold of any one of embodiments A to G wherein the compressible fluid is compressed air.

I. The stabilized pump manifold of any one of embodiments A to H wherein variation of the compressible fluid pressure is adapted to displace solids from the lower transverse surface.

J. The stabilized pump manifold of any one of embodiments A to I comprising a retainer to secure the membrane adjacent the lower transverse surface.

K. The stabilized pump manifold of any one of embodiments A to J wherein the slurry comprises an oilfield fluid and the solids comprise proppant, sand or a mixture thereof.

L. The stabilized pump manifold of any one of embodiments A to K further comprising a tapered insert in the membrane adjacent an attachment fitting.

M. A method, comprising:

reciprocating a plunger in a fluid end of a pump to alternatingly suction and discharge a slurry;

passing the slurry through a manifold in fluid communication with the fluid end, wherein the manifold comprises a lower surface transverse to vertical; and alternatingly expanding and contracting a stabilizer comprising a compressible fluid in an expandable membrane elongated along the lower transverse surface to dampen pressure oscillations within the manifold and inhibit solids settling at the lower transverse surface.

N. The method of embodiment M wherein the manifold comprises an inlet to the fluid pump and further comprising expanding the stabilizer during a low pressure cycle and contracting the stabilizer during a high pressure cycle.

O. The method of embodiment M or embodiment N comprising expanding the membrane during the low pressure cycle and compressing the membrane during the high pressure cycle.

P. The method of any one of embodiments M to O wherein a pressure variation between the low and high pressure cycles is effective to displace solids from the lower transverse surface.

Q. The method of any one of embodiments M to P comprising securing the membrane adjacent the lower transverse surface.

R. The method of any one of embodiments M to Q wherein the slurry comprises an oilfield fluid and the solids comprise proppant, sand or a mixture thereof.

S. A method for stabilizing fluid flow in a flow conduit having a lower surface transverse to vertical in contact with the fluid, wherein the fluid contains suspended solid particles and is subject to pressure oscillations, comprising:

positioning an expandable membrane along the lower transverse surface;

inflating the membrane with a gas isolated from the fluid flow;

alternatingly expanding and contracting the membrane to dampen the pressure oscillations and inhibit settling of the solid particles at the lower transverse surface.

T. The method of embodiment S wherein the flow conduit comprises an inlet manifold to a positive displacement pump, the fluid comprises a proppant- or sand-laden oilfield treatment fluid, and the expandable membrane defines a continuous, elongated chamber, preferably a hose.

U. A reciprocating pump comprising the stabilized pump inlet of any one of embodiments A to L.

V. A method comprising operating the reciprocating pump of embodiment U.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A stabilized pump manifold, comprising:

a manifold in fluid communication with a fluid end of a pump for passage of a process fluid therethrough over a lower surface transverse to vertical, wherein the lower surface is elongated in a direction of fluid flow through the manifold;

a stabilizer comprising an expandable membrane elongated along the lower transverse surface and defining a compliant chamber comprising a compressible fluid in the direction of fluid flow to dampen pressure oscillations within the manifold;

wherein the membrane is capable of expansion and contraction pulsations; and wherein the membrane is capable of actively applied expansion and contraction pulsations via external active pressurization and depressurization.

2. The stabilized pump manifold of claim 1 wherein the manifold comprises an inlet to the pump and the stabilizer is a suction stabilizer.

3. The stabilized pump manifold of claim 1 wherein the process fluid comprises a slurry, the pump comprises a plurality of chambers with reciprocating plungers to alternatingly suction and discharge the slurry, and the manifold comprises a plurality of branches transverse to the elongated lower surface to supply the slurry to the chambers.

4. The stabilized pump manifold of claim 3 wherein the manifold dissipates an acceleration head during normal operation of the plungers.

5. The stabilized pump manifold of claim 1 wherein the membrane is formed from a compliant material.

6. The stabilized pump manifold of claim 1 wherein the compliant chamber defines a continuous, elongated chamber.

7. The stabilized pump manifold of claim 1 wherein the compliant chamber comprises a hose in fluid communication with a source of the compressible fluid at a pressure exceeding a pressure of the process fluid in the manifold corresponding to a low pressure cycle.

8. The stabilized pump manifold of claim 1 wherein the compressible fluid is compressed air.

9. The stabilized pump manifold of claim 1 wherein the expansion and contraction of the membrane is adapted to inhibit solid settling in the manifold.

10. The stabilized pump manifold of claim 1 comprising a retainer to secure the membrane adjacent the lower transverse surface.

11. The stabilized pump manifold of claim 1 wherein the process fluid comprises a proppant-laden or sand-laden oilfield treatment fluid.

12. The stabilized pump manifold of claim 1 further comprising a tapered insert in the membrane adjacent an attachment fitting.

13. A reciprocating pump comprising the stabilized pump manifold of claim 1.

14. A method comprising operating the reciprocating pump of claim 13 to pump a slurry.

15. The stabilized pump manifold of claim 1 wherein the compressible fluid is at an initial pressure, and wherein the initial pressure of the compressible fluid is capable of being changed to a desired dampening so as to correspond to a discharge cycle of the pump during a particular pump operation.

16. A method, comprising:

reciprocating a plunger in a fluid end of a pump to alternatingly suction and discharge a slurry;

passing the slurry through a manifold in fluid communication with the fluid end, wherein the manifold comprises a lower surface transverse to vertical; and alternatingly expanding and contracting a stabilizer comprising a compressible fluid in a compliant chamber defined by an expandable membrane, said expandable membrane elongated along the lower transverse surface to dampen pressure oscillations within the manifold and inhibit solids settling in the manifold;

wherein the membrane is capable of actively applied expansion and contraction pulsations via external active pressurization and depressurization.

17. The method of claim 16 wherein the manifold comprises an inlet to the pump and further comprising expanding the stabilizer during a low pressure cycle and contracting the stabilizer during a high pressure cycle.

18. The method of claim 17 wherein a pressure variation between the low and high pressure cycles is effective to displace the solids from the lower transverse surface.

19. The method of claim 16 comprising securing the membrane adjacent the lower transverse surface.

20. The method of claim 16 wherein the slurry comprises an oilfield fluid and the solids comprise proppant, sand or a mixture thereof.

21. A method for stabilizing fluid flow in a flow conduit having a lower surface transverse to vertical in contact with the fluid, wherein the fluid contains suspended solid particles and is subject to pressure oscillations, comprising:

positioning an expandable membrane defining a compliant chamber along the lower surface;

inflating the membrane with a gas isolated from the fluid flow; and, alternatingly expanding and contracting the membrane to dampen the pressure oscillations and inhibit settling of the solid particles at the lower surface;

wherein the membrane is capable of actively applied expansion and contraction pulsations via external active pressurization and depressurization.

22. The method of claim 21 wherein the flow conduit comprises an inlet manifold to a positive displacement pump, the fluid comprises a proppant-laden or sand-laden oilfield treatment fluid, and the expandable membrane comprises a hose.

* * * * *